United States Patent [19]

Sommansson

[11] 4,367,383

[45] Jan. 4, 1983

[54] PUSH BUTTON MECHANISM WITH LOCKING DEVICE FOR TWO STABLE POSITIONS

[75] Inventor: Peter S. E. Sommansson, Tyresö, Sweden

[73] Assignee: Telefonaktiebolaget L M Ericsson, Stockholm, Sweden

[21] Appl. No.: 229,647

[22] Filed: Jan. 29, 1981

[30] Foreign Application Priority Data

Feb. 15, 1980 [SE] Sweden ..... 8001211

[51] Int. Cl.[3] ..... H01N 9/20

[52] U.S. Cl. ..... 200/153 J; 33/328

[58] Field of Search ..... 200/153 J, 328, 153 L, 200/159 R, 160

[56] References Cited

U.S. PATENT DOCUMENTS 3,411,376 11/1968 Weber et al. ..... 200/153 J 3,629,526 12/1971 Lewis ..... 200/153 J 4,238,653 12/1980 Brandt ..... 200/153 J

*Primary Examiner*—Willis Little

*Attorney, Agent, or Firm*—Hane, Roberts, Spiecens & Cohen

[57] ABSTRACT

A push-button mechanism, for example, for a telephone instrument of the type which from a first stable initial position of the push-button is locked in a second stable position when depressed and returns to the initial position when again depressed. The push-button mechanism contains a push-button, a rectangular body part and a cover which includes contact elements. A locking device inside the cover consists of a movably disposed plate one surface of which is constructed with a cavity in the form of a heart-shaped cam and with a concave-convex elevated part in the center of the cavity. A ball is located in a groove in the lower part of the push-button and runs along the outline of the heart-shaped cam and along the edges of the elevated part when the button is depressed.

8 Claims, 7 Drawing Figures

PUSH BUTTON MECHANISM WITH LOCKING DEVICE FOR TWO STABLE POSITIONS

FIELD OF THE INVENTION

The invention relates to a push-button mechanism with a locking device of the type that from a first stable position (the initial position) when depressed, locks the button to a second stable position and when depressed a second time, returns to the first position. Such locking function of the push-button is, for example, used in telephone instruments for connecting an extra telephone function such as a loudspeaking receiving function or the like.

BACKGROUND

It is known in push-button mechanisms of the above type to design the push-button or the elements rigidly connected to this, for example, an activating bar or a rigidly arranged planar slide with a heart-shaped cam groove in which a ball or the end of a tap-formed part runs, to obtain the bistable function when the button is depressed.

British Pat. No. 877,223, for example, describes a push-button mechanism in a ball pen in the handle of which the push-button part is formed as a sleeve whose inner cylindrical surface in the lower part is formed at a heart-shaped cam groove for cooperation with a movable ball located in the groove. Upon the first depression, the ball will run along an arcuate groove along the heart-shaped cam and assume a certain position, the sleeve being locked in the depressed position by spring action. Upon a second depression of the sleeve, the ball runs along another groove along the heart-shaped cam and the sleeve as well as the ball return to the original position.

Another similar construction of a push-button with a heart-shaped cam as a controlling element to obtain the bistable function when the button is depressed, is described in U.S. Pat. No. 3,493,705. In this construction, the heart-shaped cam is arranged on a contact slide with two oppositely located contact elements. Further examples of known push-button constructions of similar kind are represented in U.S. Pat. Nos. 3,766,346 and 3,808,388 showing a heart-shaped cam arranged on the push-button part or a part rigidly arranged to therewith.

SUMMARY OF THE INVENTION

A common characteristic of the above mentioned push-button mechanisms is that the heart-shaped cam is designed on such parts in the mechanism, which are either integrated with the push-button or with another part that performs quite another function than locking the push-button to the two bistable positions. The push-button mechanism according to the present invention employs, like the known mechanism, a heart-shaped cam and a locking slot or groove with a ball to obtain the bistable function when repeatingly depressing the push-button, but as a difference from the known arrangements, the element in which the heart-shaped cam is constructed, is movably arranged in relation to the other elements in the mechanism.

The button with a mounted heart-shaped cam represents an independent unit which is locked by the ball, keeping the heart-shaped cam and the button together which are then mounted in the mechanism.

The object of the present invention is thus to obtain a push-button mechanism, for example, included in the push-button set of a telephone instrument to obtain a bistable function of the mechanism upon two subsequent depressions of the push-button and in which the locking element is movably arranged in relation to the other elements.

The advantages of the push-button mechanism according to the invention are (a) The mounting is facilitated, since the locking unit is mechanically connected before being placed in the push-button mechanism.

(b) The ball in the locking arrangement cannot slip out of the groove when the button is tilted, nor can it jam, since the heart-shaped cam is directly controlled by the button and follows this in all movements. Since the heart-shaped cam also is loosely located between two stopping planes, jamming is prevented by the heart-shaped cam.

(c) Small sensibility of tolerance when dimensioning the push-button, the supporting base plate and other parts in the mechanism, and (d) greater flexibility when interchanging component parts as, for example, contact arrangements, push-button etc.

BRIEF DESCRIPTION OF THE DRAWINGS

In the accompanying drawings.

DETAILED DESCRIPTION

Figure 1:
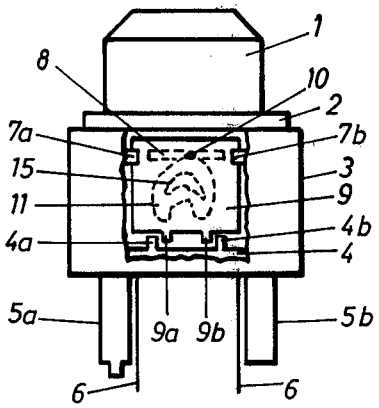
FIG. 1 shows a push-button with a cover as seen from the side with a mounted locking device according to the invention.

In FIG. 1, therein is seen a button included in a push-button 1 mechanism, for example, of, a telephone instrument. A rectangular frame 2 surrounds the button 1 and forms the a guide therefor. The frame 2 forms an integrated part of a cover 3 of the push-button mechanism, the lower part (the base part) of the cover being supplied with fastening elements in the form of two (or more) supporting pins 5*a, b.* When mounting the push-button mechanism (cover plus button) the pins 5*a, b* are inserted into the holes of a printed card and attached in a suitable way. A leaf-shaped metallic tongue 6 constitutes an electric connection and forms inside the cover 3 a contact element in a known way (not shown in the Figures). The cover 3 is broken away as shown in FIG. 1 to illustrate the position of a thin plate 9 which rests against a rigid support 4 inside the cover (the base support of the cover). For this purpose the part 4 is supplied with two knobs 4*a, b* between which two pins 9*a, b* of the plate 9 are fitted. As more fully appears from FIGS. 2 and 3, the button 1 is provided at the lower part with supporting elements for the plate 9 in the form of grip arms 7*a, b* which partly grasp the plate 9. The arms 7*a, 7b* at the same time constitute guiding elements for the push-button 1 when this is depressed. Behind the plate 9 and level with the guiding elements 7*a, b* a groove 8 is formed on the same part as these elements, which groove extends horizontally and in which a small ball 10 is located. The diameter of the ball 10 is suitably chosen somewhat larger than the width of the groove 8, the ball 10 then touching both the vertical side surfaces and the longitudinal base surface of the groove 8. The plate 9 is provided with a countersunk part 11 along one of the planar main surfaces, the outline of which describes a heart-shaped cam according to the dotted lines in the FIGS. 1 and 2. The plate 9 is inserted between the supporting arms *7a, b* so that the countersunk part 11 faces the groove 8.

Figure 2:
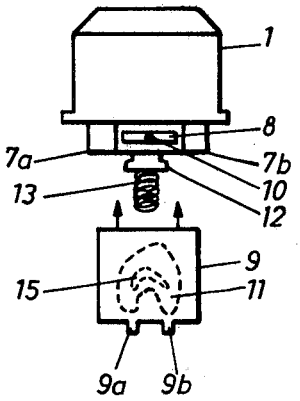
FIG. 2 shows the button and a washer or plate with a heart-shaped cam included in the locking device according to the invention.
Figure 3:
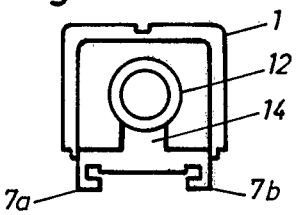
FIG. 3 shows the button alone according to FIG. 2 as seen from below.

As appears from the FIGS. 2 and 3, a hollow rod 12 is provided inside the button 1, which rod constitutes an integrated part with the two arms *7a, b* through a connection part 14. In an inner cylindrical cavity of the rod 12 a spring 13 is located. the spring 13 bears at one end against the inside of the button (the base of the rod) and at the other end against the surface 4 in the cover 3 so that a spring action is obtained when the button 1 is depressed.

The locking device includes the plate 9 with the countersunk part 11, formed as a heart-shaped cam, and the ball 10 located in the groove 8. The plate 9 in addition has an elevated part 15 in the center of the countersunk part 11, whose upper planar surface is situated level with the upper surface of the 9. As appears from the arrows in FIG. 2, the plate 9 is inserted between the supporting arms *7a, b* when mounted and the ball 10 snaps into the upper part of the countersunk part 11, i.e. the tip of the heart-shaped cam, the plate then assuming the position shown in FIG. 1. The ball 10 is now substantially freely movable within the space as track limited by the edges of the countersunk part 11 and the edges of the grove 8. The button 11 and the heart-shaped cam 9 are now mechanically connected by means of the ball 10 and operate as a bistable unit.

Figure 4:
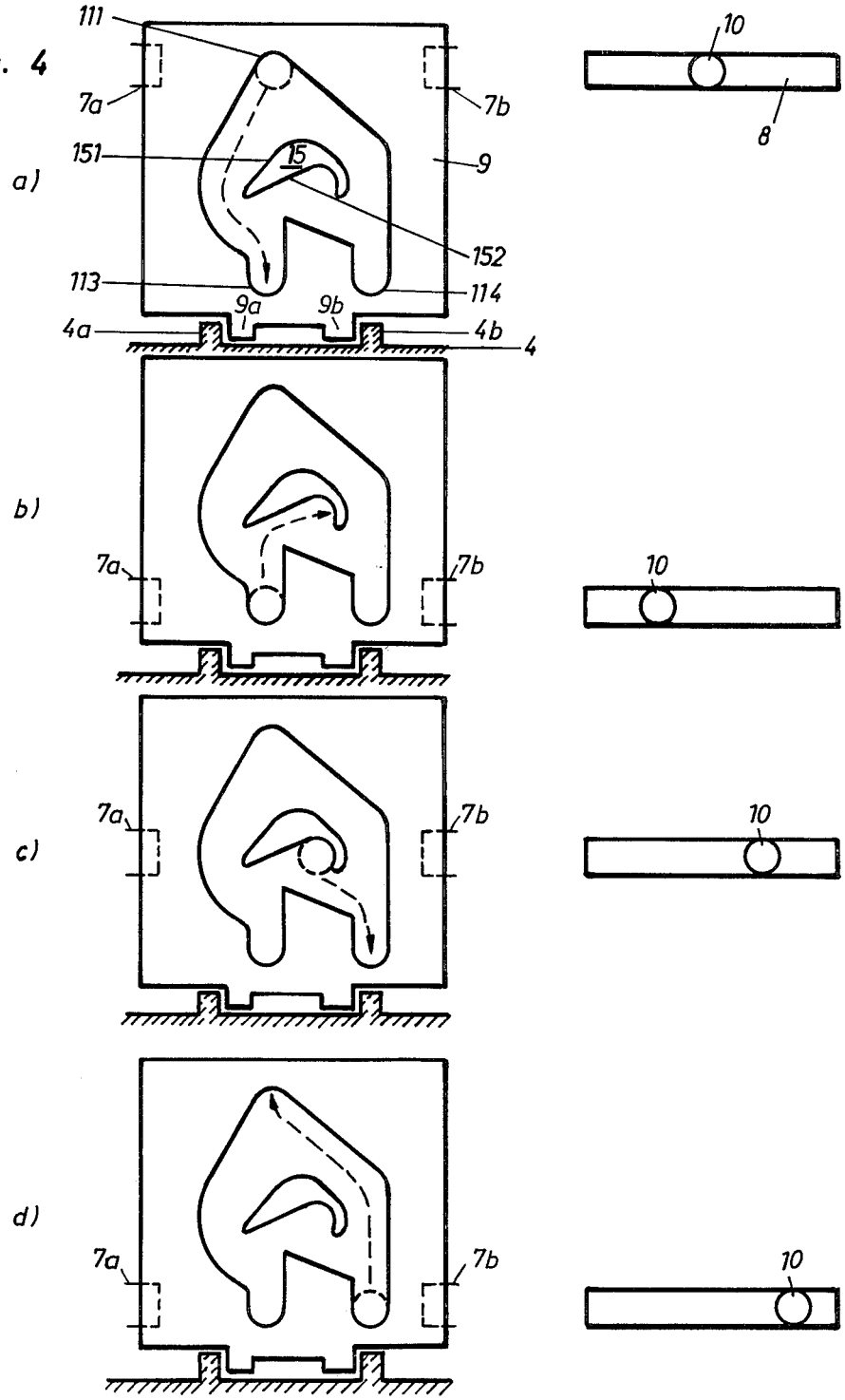
FIG. 4*a–d* show the plate according to the FIGS. 1–2 with heart-shaped cam and associated ball to illustrate the different phases upon depression.

FIG. 4*a* shows the starting position, i.e. the first stable position, when the ball 10 is located on the upper point 111 of the heart-shaped cam. The push-button 1 is then in the top position. By depressing the button 1, the upper edge surface of the groove 8 will push the ball downwards along to the path of the dotted arrow in FIG. 4*a* and the ball passes the convex edge surface 151 of the elevated part 15 and the arcuate edge surface 112 of the heart-shaped cam. The ball assumes the position according to FIG. 4*b* when the button is entirely depressed, i.e. at the semicircular edge surface 113.

When the depression of the button 1 ceases, the button is forced upwards by the spring 13 and the lower surface of the groove pushes the ball upwards to the concave surface 152 of the part 15, taking the position according to FIG. 4*c*. The push-button mechanism is then in the second stable position. When the button is depressed again, the ball is pushed downwards by the upper edge surface of the groove along the path of the dotted arrow in FIG. 4*c* and, when the button is entirely depressed, is in a final position according to FIG. 4*d*, i.e. at the semicircular edge surface 114. When the depression ceases, the button will be forced upwards by action of the spring 13, the upper edge surface of the groove then pushed the ball upwards to the initial position according to FIG. 4*a* as is shown by the dotted arrow in FIG. 4*d*.

The plate 9 with the countersunk part 11 in the form of a heart-shaped cam and the elevated part 15 in the form of a concave-convex curve is thus flexibly mounted inside the body part 3 of the push-button mechanism, and is, in principle, limited only by the two knobs 4*a*, 4*b* and the supporting arms *7a, 7b*. The heart-shaped cam which forms one part of the locking mechanism, is thus not rigidly mounted in a certain fixed position in relation to the ball 10 when this travels in the groove 8, the second part of the locking arrangement. Also the push-button is flexibly mounted in known way whereby the locking device in the present push-button mechanism complies with the advantages mentioned above.

What we claim is:

1. A pushbutton mechanism comprising a body part, a pushbutton slidably mounted in said body part for rectilinear travel in opposite directions, and a locking means for locking the pushbutton in alternation in stable raised and lowered positions upon successive depressions of the pushbutton, said locking means comprising a plate having a planar surface provided with a heart shaped cavity forming a cam and an elevated part in said cavity with concave and convex surfaces, said cavity and elevated part forming a track facing said pushbutton, said pushbutton being provided with a groove extending perpendicular to the direction of travel of said pushbutton, a ball mounted in said groove for travel therealong and engaged in said track to assume said stable raised and lowered positions as said pushbutton is successively depressed, said body part and pushbutton respectively including first and second stop means engaging and limiting movement of said plate in directions parallel and perpendicular to the direction of travel of said pushbutton to provide a loosely, floating support of said plate between two end positions in relation to the direction of travel of said pushbutton.

2. A pushbutton mechanism as claimed in claim 1 wherein said first stop means on said body part includes a pair of spaced stop elements limiting movement of said plate relative to said base part in a direction perpendicular to the direction of travel of said pushbutton, said second stop means on said pushbutton including a second pair of spaced stop elements slidably engaging said plate to permit relative sliding movement of said plate and pushbutton in the direction of travel of said pushbutton.

3. A pushbutton as claimed in claim 2 wherein said body part includes a base plate positioned to serve as a stop for said pushbutton in said lowered position, said stop elements on said body part comprising projecting knobs.

4. A pushbutton as claimed in claim 2 or 3 wherein said second pair of stop elements is located at the level of said groove at opposite ends thereof.

5. A pushbutton as claimed in claim 4 wherein said second pair of stop elements comprises grip arms slidably engaging said plate.

6. A pushbutton as claimed in claim 2 wherein said plate comprises a pair of spaced pins fitted between said knobs.

7. A pushbutton as claimed in claim 1 wherein said plate extends in a plane parallel to the directions of travel of said pushbutton.

8. A pushbutton as claimed in claim 1 comprising spring means between said pushbutton and said body part opposing depression of said pushbutton to said lowered position.

* * * * *